US011173541B2

(12) United States Patent
Biemel et al.

(10) Patent No.: US 11,173,541 B2
(45) Date of Patent: Nov. 16, 2021

(54) METHOD FOR PRODUCING A MOLDED PART AND FEEDER INSERT FOR USE IN SUCH A METHOD

(71) Applicant: Chemex Foundry Solutions GmbH, Delligsen (DE)

(72) Inventors: Michael Biemel, Würzburg (DE); Heiko Schirmer, Delligsen (DE)

(73) Assignee: CHEMEX FOUNDRY SOLUTIONS GMBH, Delligsen (DE)

( * ) Notice: Subject to any disclaimer, the term of this patent is extended or adjusted under 35 U.S.C. 154(b) by 0 days.

(21) Appl. No.: 16/954,778

(22) PCT Filed: Nov. 19, 2018

(86) PCT No.: PCT/EP2018/081696
§ 371 (c)(1),
(2) Date: Jun. 17, 2020

(87) PCT Pub. No.: WO2019/120804
PCT Pub. Date: Jun. 27, 2019

(65) Prior Publication Data

US 2021/0086256 A1 Mar. 25, 2021

(30) Foreign Application Priority Data

Dec. 22, 2017 (DE) ..... 10 2017 131 280.3

(51) Int. Cl.
*B22C 9/08* (2006.01)
*B22C 9/02* (2006.01)

(52) U.S. Cl.
CPC ..... *B22C 9/088* (2013.01); *B22C 9/02* (2013.01); *B22C 9/082* (2013.01); *B22C 9/086* (2013.01)

(58) Field of Classification Search
CPC ..... B22C 9/082; B22C 9/086; B22C 9/088
See application file for complete search history.

(56) References Cited

U.S. PATENT DOCUMENTS 4,913,218 A 4/1990 Seidinger
2004/0050526 A1* 3/2004 Skerdi ..... B22C 9/084 164/359

(Continued)

FOREIGN PATENT DOCUMENTS

DE 10039519 2/2002
DE 10059481 6/2002

(Continued)

OTHER PUBLICATIONS

EPO machine translation of DE 102015101913 B3 (Year: 2016).*
EPO machine translation of DE 102005019385 A1 (Year: 2006).*

*Primary Examiner* — Kevin E Yoon
(74) *Attorney, Agent, or Firm* — Duane Morris LLP; Gregory M. Lefkowitz; Brandon A. Chan

(57) ABSTRACT

The invention relates to a method for producing a mold part (26, 26') with a feeder insert arranged in it, with a sprue for liquid metal, for a divisible casting mold for metal casting, with the following steps:

Figure 1:
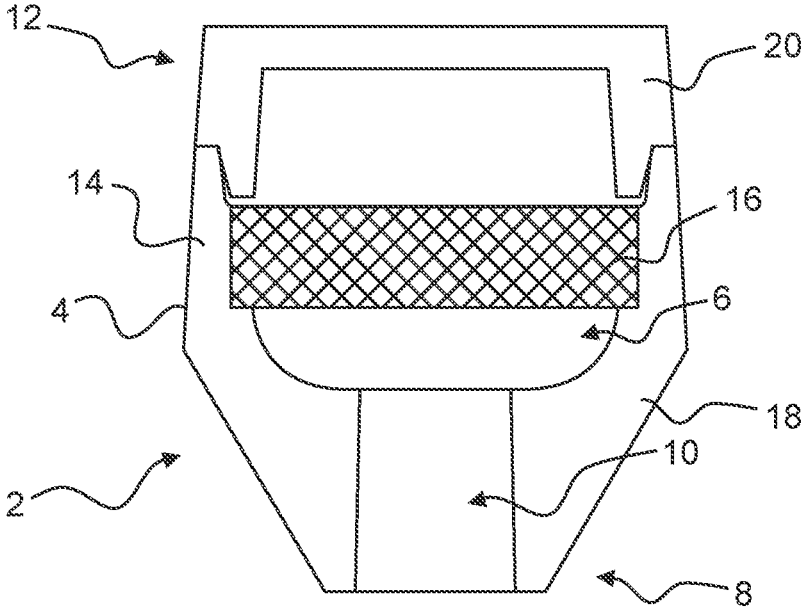

producing or providing a mold part (26, 26') equipped with a closed feeder insert (2, 2') from a compacted molding material (28), the closed feeder insert (2, 2') being arranged fixed in place in the compacted molding material (28) of the mold part (26, 26') and having a feeder opening (10, 10') connected to regions of the mold cavity (30, 30') that is to be formed, and opening the closed feeder insert (2, 2'), so that a sprue (32, 32') for liquid metal is formed.

11 Claims, 10 Drawing Sheets

(56) References Cited

U.S. PATENT DOCUMENTS

| | | | | |
|---|---|---|---|---|
| 2004/0256075 | A1* | 12/2004 | Schafer | B22C 23/00<br>164/359 |
| 2009/0301684 | A1* | 12/2009 | Beckmann | B22C 9/088<br>164/137 |

FOREIGN PATENT DOCUMENTS

| | | |
|---|---|---|
| DE | 202004009367 | 8/2004 |
| DE | 202006011980 | 10/2006 |
| DE | 102005019385 | 11/2006 |
| DE | 202013001933 | 5/2014 |
| DE | 102015101913 | 5/2015 |
| EP | 0630708 | 12/1994 |
| JP | H0466244 | 3/1992 |
| JP | 2001079646 | 3/2001 |
| WO | 2005051568 | 6/2005 |
| WO | 2005095020 | 10/2005 |

* cited by examiner

METHOD FOR PRODUCING A MOLDED PART AND FEEDER INSERT FOR USE IN SUCH A METHOD

CROSS-REFERENCE TO RELATED APPLICATIONS

This application is a § 371 national stage entry of International Application No. PCT/EP2018/081696, filed on Nov. 19, 2018, which claims priority to German Patent Application No. 102017131280.3, filed on Dec. 22, 2017, the entire contents of which are incorporated herein by reference.

The present invention relates to a method for producing a mold part with a feeder insert arranged on it, with a sprue for liquid metal, for a divisible casting mold for metal casting. What is more, the invention also relates to a mold part for a divisible casting mold and also to a casting mold comprising at least two mold parts. Furthermore, the invention also relates to a feeder insert for use in a method for producing a mold part and also to the use of a closed feeder insert. The invention is defined by the claims and is disclosed in detail in the following description.

Feeder inserts are used in large number and great variety for the casting of metals in casting molds. Feeder inserts, also referred to as feeder systems, are surrounded at least in certain regions by a molding material used for producing the casting mold, such as for example a molding sand. By means of the molding material surrounding the feeder insert, the feeder insert is held in a predetermined position within the casting mold. Known feeder inserts have a feeder cavity with a through-opening for the liquid metal. By way of the through-opening, also referred to hereinafter as feeder opening, a connection to regions of the mold cavity to be formed of the mold part is created. Some of the metal filled into the mold cavity of the casting mold during the casting operation enters the feeder insert through the feeder opening, and thereby enters the feeder cavity. The liquid metal that has entered the feeder cavity is intended to be able to flow back into the casting mold during the solidifying process of the metal in the casting mold, which involves a contraction of the casting metal. This balances out or compensates for the shrinking of the cast part until it reaches the solidus temperature.

In order to be able to ensure the flowing back of the metal, the metal located in the feeder insert is kept in the liquid state for a time, until the metal present in the interior of the casting mold is already solidified or already partially solidified to form the cast part. For this purpose, at least part of the feeder insert usually consists of an insulating and/or exothermic material.

For filling the liquid metal into the casting mold, some embodiments of feeder inserts, primarily closed feeder inserts, involve the associated use of a gating system, to be created when producing the mold part, is used. One disadvantage that occurs when using a gating system is the increased proportion of the liquid material for producing a cast part that has to be used, which may make up a proportion of around up to 50% of the material for the casting. To avoid such a gating system, it is already known in the area of casting technology to use feeder sprue systems by way of which the pouring of the liquid metal into the mold cavity of the casting mold takes place.

DE 39 01 602 C2 discloses such a feeder sprue system for a casting mold. The casting mold has a mold cavity and a sprue, which connects the mold cavity to the outer side of the casting mold and has a pouring funnel and a feeder insert arranged in a portion of the sprue. The feeder insert is on the one hand open in the direction of the pouring funnel and on the other hand has a feeder opening in the direction of a mold cavity, which is formed by regions of a mold half or a mold part. For technical production-related reasons, it is only after the production or formation of the mold part that such an open feeder insert is inserted into a recess formed on the mold part, which is intended and correspondingly dimensioned for receiving the feeder insert. This recess for the feeder insert into which the feeder insert is inserted on the finished mold part after the mold part has been created must be taken into consideration when producing the mold part. When inserting the feeder insert into the recess, which may be performed for example manually or with an inserting device, it may however happen as a result of inaccuracies that the feeder insert is not positioned exactly in the recess. This may lead in particular to irregularities on a cast part produced and to laborious reworking. In particular, inaccurate insertion of the feeder insert into the recess may have the consequence that the cast part produced is unusable.

DE 10 2015 101 913 B3 discloses an open feeder insert, also referred to as a sprue feeder. The feeder insert has a body, which comprises a cavity for receiving molten metal. The body has an upper part and a lower part, connected to the upper part. The lower part defines a feeder opening of the sprue feeder. The cover of the upper part has an opening opposite the feeder opening. The cavity in the body receives a loose refractory filter, which is larger than the feeder opening.

DE 10 2005 019 385 A1 shows a feeder for inserting into a casting mold having a casting cavity, with a feeder cavity that is open on opposite sides of the feeder. A first opening establishes a connection from the feeder cavity to the casting cavity. A second opening is arranged opposite the first opening, a filter element being arranged in the half of the feeder cavity that is facing the second opening.

EP 0 630 708 A2 discloses a device for producing a pouring opening or venting bore in a casting mold from compacted molding sand.

JP 2001 079646 A discloses a method for producing a casting mold with a pouring opening, in which a mold pattern and a sprue bush inserted into a molding box and the molding box is filled with molding sand. The sprue bush is shorter than the molding box and is not damaged during the pressing of the molding sand. After the pressing, the region above the sprue bush is exposed with the aid of a cutting tool.

The invention was based on the object of providing a method for producing a mold part with a feeder insert arranged on it, with a sprue for liquid metal or a feeder insert for use in a method for producing a mold part, with which the production of a mold part or a casting mold to be formed from it is possible while avoiding the disadvantages described above.

The invention achieves the object underlying it in a first aspect by a method for producing a mold part with a feeder insert arranged in it, with a sprue for liquid metal, for a divisible casting mold for the metal casting with the features of claim 1. In particular, the method achieves the object by the following steps: producing or providing a mold part equipped with a closed feeder insert from a compacted molding material, the closed feeder insert being arranged fixed in place in the compacted molding material of the mold part and having a feeder opening connected to regions of a mold cavity that is to be formed or has partially formed, and opening the closed feeder insert, so that a sprue for liquid metal is formed.

The invention is based in particular on the realization that, by means of the method steps according to the invention, a mold part with a feeder insert arranged in it or on it is provided or can be produced, in the case of which the pouring in of the liquid metal is possible by way of the feeder insert, an (initially) closed feeder insert being used, by contrast with the prior art, for producing the mold part with the sprue feeder arranged in it. Using a closed feeder insert achieves the effect of minimizing the probability of the molding material getting into the feeder cavity of the feeder insert while the mold part is being produced from a molding material to be compacted. The opening of the closed feeder insert only takes place after finishing the mold part, and consequently only after the molding material used for producing the mold part has been compacted. With the opening of the closed feeder insert, the sprue for the liquid metal is then formed. An initially closed feeder insert arranged correspondingly in or on the mold part is only transformed into an open feeder insert, and consequently into a sprue feeder, after the production of the mold part itself. Mold parts that can be produced according to the invention can be created in a simplified manner, in particular by means of so-called modern green sand molding machines (for example Disamatic molding machines from the company DISA Industries A/S). In one embodiment of the invention, the steps of producing the mold part with a closed feeder insert arranged on it and the opening of the closed feeder insert are performed in steps following directly one after the other. In an alternative embodiment, it is provided that the production of the mold part with the feeder insert arranged on it are separated in time from the step when, and/or are locationally kept at a distance from the position at which, the opening of the closed feeder insert and the forming of the sprue on the feeder insert for the liquid material is performed.

In a preferred method according to the invention, the production of the mold part equipped with the closed feeder insert comprises the following steps: arranging the closed feeder insert in a molding chamber or a molding box; filling molding material into the molding chamber or the molding box, the closed feeder insert being surrounded at least in certain regions by the molding material; and compacting the filled-in molding material, so that the mold part is produced and the closed feeder insert is received fixed in place in the compacted molding material. The arranging of the closed feeder insert preferably takes place using auxiliary means, on which the feeder insert is received, and/or with which the feeder insert is arranged together in relation to a molding chamber or a molding box. With the filling of molding material into the molding chamber, the closed feeder insert is surrounded at least in certain regions by molding material. In one embodiment of the invention, in particular the region, or in particular the regions, in which the sprue for the liquid metal is to be created is/are not covered by molding material. Preferably, after the filling in of the molding material, the closed feeder insert is surrounded by molding material over the full circumference, at least over a portion in the direction of its longitudinal axis. After the filling in of the molding material, the molding material is then compacted, the compacting of the molding material having the effect that the mold part is given its final form and the feeder insert is received and arranged fixed in place in the mold part of compacted molding material. Receiving fixed in place should be understood in the present case as meaning that the still closed feeder insert can no longer be moved in relation to the compacted mold part. With the compacting of the molding material, it is usually at least achieved that a frictional connection is formed between the areas of the feeder insert and the regions of the mold part that are lying directly in contact with one another. There is preferably a frictional engagement between the surfaces of the feeder insert and the mold part that are lying in contact with one another. In a preferred embodiment of the method according to the invention, a defined amount of molding material is introduced into the molding chamber, so that after the compacting of the molding material the feeder insert is enclosed over its entire height by molding material of the mold part. On the other hand, the upper end of the feeder insert is preferably not covered by molding material, so that the sprue is formed from a pouring opening on the feeder insert. In a further embodiment of the invention, it is provided that the upper end of the feeder insert should also be covered by compacted molding material of the mold part, so that the sprue for the liquid metal is obtained by removing material of the compacted molding material and opening the (initially closed) feeder insert.

Moreover, the production of the mold part equipped with the closed feeder insert preferably comprises the step of compacting the molding material in contact with the closed feeder insert, so that the closed feeder insert is embedded in an interlocking manner in the mold part produced. The closed feeder insert is therefore preferably so dimensioned or specifically designed in its form, and also preferably a defined amount of molding material is so filled into the molding chamber or into the molding box that, after the compacting of the molding material, wall regions of the closed feeder insert are preferably reached over in the radial direction with respect to the pouring-in direction of the liquid metal, so that the feeder insert is fixedly embedded in the compacted molding material of the mold part. This ensures that the closed feeder insert is arranged immovably within the mold part produced. Consequently, the reliability in the production of the mold part is further improved. In one embodiment of the invention, it is preferably provided that, when producing the mold part, the closed feeder insert is completely covered by the molding material forming the mold part at the end opposite from the end with the feeder opening, and is consequently completely received in the mold part. Consequently, the closed feeder insert cannot be seen initially (before opening) from the outer side of the mold part.

The production of the mold part equipped with the closed feeder insert preferably comprises the following steps: positioning the closed feeder insert on a mold plate and/or on a mold pattern or at a distance from a mold plate and/or a mold pattern, the closed feeder insert being positioned preferably manually or in an automated manner by means of a positioning device, and forming a or the molding chamber or a or the molding box for the molding material to be compacted, preferably at least in certain regions, from the mold plate and/or the mold pattern and at least one pressing plate that is movable in relation to the mold plate and/or the mold pattern. In order to be able to arrange the closed feeder insert within a molding chamber or a molding box, a mold plate, also referred to as a pattern plate and/or a mold pattern, is preferably used as an auxiliary means. The closed feeder insert is in particular positioned fixedly on the mold plate and/or the mold pattern, in one embodiment a centering pin or a correspondingly suitable positioning means for the closed feeder insert being provided on the mold plate or the mold pattern. In particular, the closed feeder insert is pushed with its feeder opening onto the centering pin or the positioning means. Preferably, the centering pin or the positioning means is adapted in its dimensions to the dimension of the feeder opening. The positioning takes place either manually or by means of a positioning device receiving the closed feeder insert. Once the closed feeder insert has been positioned on the mold plate and/or the mold pattern, which itself may be arranged on a mold plate or a pattern plate, the mold plate or the mold pattern with the closed feeder insert positioned on it is moved into a position and/or is brought into alignment with a pressing plate and side walls delimiting the molding chamber or the molding box. For producing the mold part, the mold plate and/or the mold pattern define at least one region of the molding chamber or the molding box into which the molding material can be filled, in particular injected.

Preferably, a defined amount or a presettable amount or mass of molding material is filled, in particular injected, into the molding chamber or the molding box. The injection of the molding material accomplishes a shortened filling operation of the molding chamber or the molding box; consequently, the time for the production of the mold part can be shortened. According to a refinement of the present method according to the invention, the molding material is preferably injected into the molding chamber under high pressure. The molding chamber of the molding box is preferably completely filled by the molding material used for forming the mold part.

In a preferred method according to the invention, the following steps are also provided when producing the mold part equipped with the closed feeder insert: providing a closed feeder insert that is compressible substantially along its longitudinal axis, and compressing the closed feeder insert in the direction of its longitudinal axis when compacting the molding material. Using closed, compressible feeder inserts achieves the effect that the high pressure acting on the feeder insert when compacting or during the compacting of the molding material can be partially equalized or compensated. Instances of damage or even breakage of the feeder insert when compacting the mold part are consequently avoided in an advantageous way. This in turn increases the reliability in the production of the mold parts with the aid of the method according to the invention. A compressible feeder insert should be understood in the present case as meaning a feeder insert which can reduce its dimension in the direction of the longitudinal axis when compacting or during the compacting of the molding material as a result of compressive forces acting in the longitudinal direction. In particular, there is a reduction in the distance between the end of the feeder insert having the feeder opening and the opposite end of the feeder insert, in which preferably the sprue in the form of a pouring opening for the liquid metal is to be created by opening the closed feeder insert. Compressible feeder inserts and/or compressible components thereof, the use of which is preferred in the context of the present invention, are defined for example in the claims of DE 100 39 519 A1, DE 100 59 481 A1, DE 10 2015 101 913 B3, DE 20 2004 009 367 U1, DE 20 2013 001 933 U1, EP 1 567 294 B3, EP 1 879 710 B1 and WO 2005/095020 A2. It should be noted that technically analogous devices and device component parts are not referred to identically throughout the written prior art; the context of the respective disclosure should be taken into consideration in the usual way.

In a preferred method according to the invention, said method is distinguished by the following step during the production of the mold part: providing a closed one-part or a closed multi-part, preferably compressible feeder insert, a filter element being fitted into the one-part or multi-part feeder insert after or before the opening of the feeder insert, the filter element preferably being held in position after its fitting by means of at least one securing element. Fitting a filter element achieves the effect that foreign bodies are preferably not introduced with the liquid metal into the mold cavity of the casting mold created by means of the mold part by the pouring in of the liquid metal by way of the sprue of the feeder insert. The molten material is consequently cleaned. Furthermore, when the liquid metal is being poured into the sprue feeder, the molten material flow is killed by the filter element. In particular, in the case of a closed one-part feeder insert according to one possible embodiment of the invention, the filter element is fitted after the opening of the feeder insert in the feeder cavity of the latter. In the case of a closed multi-part feeder insert, the filter element is preferably fitted before the opening of the feeder insert into the feeder cavity. The filter element is preferably inserted during the production of the feeder insert, in particular before the joining of the multiple individual parts to form the closed multi-part feeder insert, in the feeder cavity of the latter.

The filter element inserted into the feeder cavity of the feeder insert is preferably held in position after fitting with the aid of at least one securing element. When there is a movement of the feeder insert during the transport or production of the mold part, the correspondingly arrested filter element is hindered from moving within the feeder insert. This counteracts in particular canting of the filter element, so that it can always perform its original function, that is to say filtering the molten material during filling. According to one embodiment, a securing element or a number of securing elements is/are used for holding the filter element in position within the feeder cavity. The securing element or elements is/are preferably formed completely or partially from a thermally destructible material, for example a material of plastic, paperboard, paper or a combination thereof. With the filling of liquid metal into the feeder insert, the filter element is released, so that it is provided with a limited space for movement within the feeder insert. In particular, the securing element can be destroyed and the filter element can float in the feeder element on the liquid metal rising up in the feeder element. The floating of the filter element in the feeder cavity of the feeder insert causes the effective feeding volume to increase in size, and consequently its feeding effect to be improved. The filter element is preferably arrested by means of a ring, for example of foam, or by means of a number of securing wedges arranged in a distributed manner over the circumference of the filter element.

Preferably provided is a closed multi-part feeder insert with a filter element already arranged in it, and in particular held in position by means of at least one securing element, which is positioned on a mold plate or a mold pattern and is then preferably arranged together with the mold plate and/or the mold pattern in a molding chamber or a molding box. Preferably, the filter element is received fixedly or movably in a receiving region in the feeder cavity of the closed feeder insert. In particular when positioning the feeder insert on a mold plate, in the case of a multi-part feeder element, a filter element already arranged in it may be moved to the side when the feeder insert is pushed onto for example a centering pin. The movable reception of the filter element in the feeder insert also has the advantage that, when the liquid metal rises up into the sprue feeder, the filter element can float, whereby the feeder cavity of the feeder insert that is then open according to the invention is increased in size, which makes it easier for the mold cavity to be replenished during the solifying of the cast part.

In a preferred method according to the invention, the opening of the closed feeder insert comprises one, more than one, or all of the following steps: changing the position of, preferably turning, the mold part produced together with the closed feeder insert arranged fixed in place before the opening of the feeder insert, so that the part of the feeder insert later having the sprue is arranged with respect to a horizontal plane underneath the feeder opening connected to regions of the mold cavity to be formed; opening the feeder insert at a position at a distance from the feeder opening, in particular at an end portion of the feeder insert opposite from the feeder opening; and working the closed feeder insert or working the closed feeder insert and regions of the compacted molding material surrounding the feeder insert for opening the feeder insert in a or the changed position of the mold part produced, together with the feeder insert received fixed in place. With the aid of the method steps according to the invention, the mold part together with the closed feeder insert received on it or in it is turned before its opening such that the feeder insert is inverted in relation to its otherwise usual alignment during use.

In the method according to the invention, before the opening of the feeder insert, the feeder opening is preferably arranged (in the way stated or in some other way) above the region of the feeder insert that is to be opened and in which the sprue for filling in the liquid metal is to be formed.

Preferably, the sprue formed at least as a pouring opening in the feeder insert is created at the end or end portion of the feeder insert opposite from the feeder opening (the upper end during its use). This has the effect that, between the pouring opening and the feeder opening, from which the liquid metal flows away in the direction of the mold cavity of the casting mold, there is formed a sufficiently great distance that can be used as a feeder cavity, and consequently as a reservoir for replenishing the material in the mold cavity.

Preferably, the feeder insert, in particular the end portion of the closed feeder insert opposite from the feeder opening, is worked, in particular once the mold part produced has been turned and the region to be opened consequently lies underneath the feeder opening. This avoids molding material penetrating into the feeder cavity during the opening of the closed feeder insert. Instead, on account of the gravitational force acting in the opposite direction, material of the feeder insert that becomes detached or molding material of the mold part that becomes detached is carried away downwardly of its own accord. For working, in particular for opening the closed feeder insert, preferably corresponding tools are used, such as for example drills or milling cutters, with which at least the pouring opening in the feeder insert is drilled or milled.

A preferred method according to the invention provides the step of opening the closed feeder insert and forming the sprue on the feeder insert or on the feeder insert and the produced mold part by machining, leaving after the formation of the sprue regions of the mold part which reach over, preferably reach over substantially radially, wall regions of the feeder insert with respect to the pouring-in direction for the liquid metal, so that an undercut enclosing the feeder insert is formed and/or removal of the feeder insert from the mold part produced is prevented. Preferably, the upper end of the feeder insert intended for opening, which is preferably completely covered by the compacted molding material for the mold part, is only partially exposed. The compacted and solid molding material of the mold part reaches over peripheral regions of the feeder insert at the upper end or protrudes inwardly beyond these peripheral regions in the radial direction. This ensures that in particular it is also possible to use closed feeder inserts which, on account of their shaping, do not enter into any, or any mechanically significant, interlocking engagement with the mold part along their outer side during compacting of the molding material. Thus, also in the case of such feeder inserts, a secure hold in the mold part is brought about. A feeder insert which has for example a conical outer contour in its longitudinal direction can thus be received fixed in place within the mold part.

A further aspect of the present invention relates to a mold part for a divisible casting mold, in particular for metal casting, comprising at least one feeder insert received fixed in place in the compacted molding material of the mold part. To this extent too, the invention achieves the object underlying the method according to the invention, in that the feeder insert has a sprue for liquid metal and a feeder opening connecting the feeder insert to parts of the mold cavity, it being possible for the mold part to be produced by a method according to one of the preferred embodiments of the invention described above and/or the mold part having regions which reach over, preferably reach over substantially radially, wall regions of the feeder insert with respect to the pouring-in direction for the liquid metal, so that an undercut enclosing the feeder insert is formed and/or removal of the feeder insert from the mold part is prevented. The invention is based in particular on the realization that, by using a closed feeder insert, mold parts for a divisible casting mold can also be produced in an easy way. In particular, after the forming of the closed feeder insert as a sprue feeder, the then open feeder insert cannot so easily be removed from the mold part on account of it being received fixed in place within the mold part. Preferably, the subsequently opened sprue feeder is received in an interlocking manner within a recess in the compacted mold part. In a preferred refinement, a filter element of porous material is arranged within the feeder insert, in particular in the feeder cavity. With the aid of the filter element, the liquid metal filled in by way of the sprue of the feeder insert is cleaned, so that no foreign bodies or undesired constituents are introduced with it into the casting to be produced. Preferably, the mold part forms a partial region of a casting mold, area regions of the mold part defining the outer side of the casting mold and at least one area forming a parting area on the mold part, with which a parting area of at least one further mold part can be brought into contact for forming the casting mold.

Preferably, the mold part according to the invention, equipped with the feeder insert, the feeder insert having been opened subsequently (preferably after the production of the mold part) and being covered over on its upper side by material regions of the compacted molding material forming the mold part, has a sprue with a pouring opening at the feeder insert, a runner corresponding to the pouring opening and, on the upper side of the mold part, a pouring cup in the compacted molding material. Preferably, a runner corresponding to the pouring opening, and possibly a pouring cup, are formed by means of the compacted molding material of the mold part and are preferably formed by a working tool together with the pouring opening on the feeder insert.

According to a further aspect, the invention relates to a casting mold comprising at least two mold parts, with a first mold part and a second mold part, which have parting areas that can be brought into contact with one another and are designed for being joined together to form at least part of the mold cavity. According to the invention, at least one of the mold parts is a mold part according to the invention, preferably one according to one of the preferred embodiments described above.

The casting mold according to the invention consequently has at least one mold part according to the invention, within which a (preferably originally closed) feeder insert is received fixed in place in the compacted molding material, the feeder insert having a sprue for liquid metal and a feeder opening connecting the feeder insert to parts of the mold cavity, and, according to a (first) embodiment of the casting mold according to the invention, the mold part having regions which reach over, preferably reach over substantially radially, wall regions of the feeder insert with respect to the pouring-in direction for the liquid metal, so that an undercut enclosing the feeder insert is formed and/or removal of the feeder insert from the mold part is prevented, and/or, according to a further (second) embodiment of the casting mold according to the invention, the mold part, as described above according to the preferred embodiments, has in particular been provided or produced according to the invention and opened for forming a sprue for liquid metal. By means of a casting mold formed in such a way according to the invention, a casting can be produced in a reliable and efficient way, without the risk that undesired constituents of the molding material forming the mold part get into the mold cavity during production of the mold part, and consequently before casting. The creation of the casting mold with the mold cavity for the cast part to be produced takes place by at least joining together the parting areas that can be brought into contact with one another of at least a first mold part and a second mold part. Preferably, the mold part with the sprue feeder received in it fixed in place, also referred to as the sprue feeder insert, is arranged such that the pouring opening on the feeder insert is arranged above the feeder opening of the feeder insert during use of the casting mold.

The preferred features, embodiments or developments described with respect to the method according to the invention for producing a mold part are at the same time also preferred features, embodiments or developments of the mold part according to the invention and also of the casting mold according to the invention, and vice versa.

According to a further aspect, the invention relates to a feeder insert for use in a method according to the invention, preferably according to one of the preferred refinements described above, comprising at least one feeder body, which forms at least a region of a feeder cavity for receiving liquid metal.

The feeder insert according to the invention achieves the object described at the beginning in that the feeder insert has at a first end in the feeder body a feeder opening for the passing through of liquid metal, is formed as closed at a second end opposite from the first end and has side walls extending between the first end and the second end, the feeder insert being a multi-part feeder insert and a filter element being arranged within the feeder cavity, or being a one-part or multi-part (preferably one-part) feeder insert and having in the feeder cavity a receiving region for a filter element that can be inserted into the feeder cavity. A feeder insert that is formed in such a way according to the invention is designed or prepared to be used as a sprue feeder insert, in particular once the feeder insert has been opened at the second, closed end and a sprue has been formed in the form of a pouring opening for liquid metal. A closed feeder insert formed in such a way according to the invention can be received relatively easily within a mold part to be produced. When producing the mold part, in particular when compacting the molding material used for producing the mold part, the entry of parts of the molding material into the interior of the feeder insert, in particular its feeder cavity, is prevented by its closed configuration. In one embodiment of the feeder insert according to the invention, if the feeder insert is a multi-part insert, the filter element is preferably arranged fixedly within the feeder cavity. In an alternative embodiment, in which the feeder insert is a one-part or multi-part insert and has a receiving region for a filter element, a filter element is preferably fitted or inserted into the feeder cavity subsequently, in particular after the opening of the closed feeder insert. The subsequently fitted filter element is in particular movable within the feeder element according to the invention and can preferably float in the feeder cavity within the sprue-feeder insert.

According to a preferred embodiment, at least one securing element that holds the filter element in position is arranged in the feeder cavity and/or a contact region for at least one securing element which is designed to hold in position the filter element that can be inserted into the receiving region of the feeder cavity is provided in the feeder cavity. By means of the one securing element or the number of securing elements, the filter element is held in position, in particular in the case of a correspondingly prefabricated feeder insert, for example during transport or when moving the feeder insert during production of the mold part according to the invention. The securing element hinders a relative movement between the filter element and the feeder insert. With the aid of the securing element, canting or upending of the filter element within the feeder cavity is counteracted. With the filter element held in position, the effect is also achieved that, with the opening of the feeder insert, in particular the milling open of the feeder insert, for producing the pouring opening for the liquid metal, and the subsequent rotating of the mold part produced, loose molding material cannot get past the filter element into the interior of the mold cavity of the mold part via the feeder insert. Preferably, the filter element has an outer diameter that is about 0.2 to 1.5 cm smaller than an inner diameter of the receiving region receiving the filter element in the feeder cavity. Instead of a circular outer circumference, the filter element and also the corresponding receiving region receiving the filter element may have any desired form, the filter element having smaller dimensions than the receiving region on the feeder insert.

According to a preferred embodiment of the present invention, the securing element or the number of securing elements comprises/comprise a thermally destructible material or the securing element or securing elements are formed from such a material; for suitable materials, reference should be made to the statements given above. The securing element has the property of being destroyed, preferably of burning, when the liquid metal is filled into the feeder insert. In this way, the securing element or securing elements releases or release the filter element within the feeder insert, so that the filter element can if need be float within the filter insert. In this way, the feeding effect of the feeder insert according to the invention is improved. According to a preferred embodiment, a plastics material, preferably a foam, is used as the material for forming the securing element. Instead of a foam, any other suitable material that is destroyed, in particular burned, with little residue, preferably no residue, such as for example paper or paperboard, can be used for forming the securing element. According to one possible refinement of the invention, one or more adhesive spots of preferably a hotmelt adhesive (of plastic), which dissolve on contact with the liquid metal, may also be used as the securing element.

According to a preferred embodiment of the feeder insert according to the invention, the feeder body has a feeder element and a further feeder part, which partially delimit the feeder cavity for receiving liquid metal. Preferably, the feeder body is of multi-part form, the feeder element and the feeder part being fixedly or releasably connected to one another. In the connecting region between the feeder element and the feeder part, there is preferably an opening region, through which for example the filter element can be inserted into the commonly formed feeder cavity. Preferably, the feeder element and the further feeder part are fixedly connected to one another. Preferably, in one embodiment of the invention, the feeder element may be connected to the feeder part in a material-bonded manner. Preferably, the feeder element is the component that is directly in contact with a mold plate or with a mold pattern or is positioned at a small distance from the mold plate and/or the mold pattern. The feeder element is preferably compressible, particularly preferably irreversibly compressible, and may preferably be formed as a metal sleeve, which has a wall with a substantially uniformly cylindrical diameter or a step-shaped wall. Compare once again the disclosure of the aforementioned patent documents. The feeder part forms in particular the closed end of the feeder insert and at least portions of the side walls of the feeder body extending between the first end and the second end.

According to a preferred development of the feeder insert according to the invention, the feeder body is closed at its second end by means of a cover. In particular in the case of a feeder insert of a one-part form, which is not formed as compressible in the longitudinal direction, preferably a filter element is already fitted into the feeder cavity before the opening of the feeder insert, in that the feeder body has a removable cover. After inserting the filter element into the feeder cavity of the feeder insert, the cover is connected again to the rest of the feeder body, so that the feeder body ends up being a one-part identity. In the present case, the term "one-part" should be understood as meaning that the feeder body is formed from multiple individual parts, which however are not intended to be separated from one another and put together again as often as desired or designed to be moved in relation to one another. Rather, the feeder body is of a "one-part" form if, although it is made up of multiple individual parts, the individual parts are intended to act permanently together with one another. Such a one-part feeder body preferably cannot be reversibly dismantled into its individual parts, i.e. after dismantling cannot be readily put together again to form a functional whole. A multi-part feeder insert should be understood in the present case as meaning a feeder insert made up of multiple individual parts with a feeder body of which the individual parts preferably allow a relative movement of specific individual parts in relation to one another during use of the feeder insert and/or the individual parts of which can be reversibly separated from one another and joined together again as often as desired. In the case of a multi-part feeder insert, the cover, which is part of the feeder body, is preferably connected at the second end of the feeder body to a feeder part of the feeder body which in a corresponding embodiment forms a middle part of the feeder insert. Preferably, the feeder element and the feeder part of the feeder body are formed from different materials.

According to a preferred refinement of the feeder insert according to the invention, the feeder element and the further feeder part of the feeder body or the feeder element and the cover closing the feeder body at the second end are formed as telescopically displaceable in relation to one another and/or the feeder element or the further feeder part are formed as compressible, in particular as non-reversibly compressible. Preferably, the feeder body is formed as compressible along its longitudinal axis, so that the distance between the opposite ends of the feeder insert is variable. In the case of a closed feeder insert formed as a telescopic feeder insert (cf. DE 100 39 519 A1), the feeder element and the further feeder part are moved in relation to one another. Preferably, the further feeder part, on which the pouring opening for the liquid metal is formed, is pushed, in particular with a portion thereof, over the feeder element when compacting the molding material. In this case, the feeder element and the further feeder part are not intrinsically formed as deformable. The feeder element with the feeder opening formed on it does not itself change its position in relation to the mold plate or the mold pattern. Consequently, when compacting the telescopic feeder, primarily the feeder part is moved.

In an alternative embodiment, the telescoping capability of the multi-part feeder insert is brought about between the feeder element and a cover closing the second end of the feeder body. Preferably, for this purpose the cover reaches over the outer side or the outer circumference of the side wall of the feeder element of the feeder body with its side walls running approximately parallel thereto. Contrary to the previous embodiment, only the cover is moved in relation to the feeder element. Preferably provided on the inner side of the cover is a movement stop, which comes into contact with the second end of the feeder element when compacting the molding sand during the production of the mold part. This preferably limits the extent to which the feeder insert, in the present case the feeder element and the cover, can be telescoped in relation to one another. Consequently, a sufficiently large feeder cavity remains within the feeder insert as a reservoir for the liquid metal for replenishing.

According to an alternative embodiment, in which preferably the feeder element is formed as compressible, in particular non-reversibly (i.e. irreversibly) compressible, when compacting the molding material the feeder element is compressed in such a way that once again a relative movement is brought about between the feeder element and the further feeder part. Rather, the feeder element is in itself deformed, the distance between the end of the feeder element resting on the mold plate or the mold pattern and the end of the feeder element in contact with the further feeder part being reduced as the mold part is compacted. In this case, in one embodiment of the invention, the feeder part may additionally be pushed (at least partially) over the deforming feeder element. It may likewise be envisaged to form a portion of the further feeder part as compressible in the longitudinal direction of the feeder insert.

With the aid of the feeder inserts formed as compressible along the longitudinal axis, the pressure occurring in particular when compacting the molding material in the mold part is equalized or compensated by the feeder inserts according to the invention. As a result, damage or even breakage of the feeder insert when producing a mold part according to one of the preferred embodiments described above is avoided.

According to a preferred embodiment, a compressible, in particular non-reversibly compressible, feeder element is formed from a thin-walled metal material, such as for example steel.

According to a further aspect, the invention likewise relates to the use of a closed feeder insert, in particular a feeder insert according to the invention, preferably according to one of the preferred embodiments described above, in a method for producing an arrangement comprising a mold part and a feeder insert according to the invention (preferably according to one of the preferred embodiments described above) or for producing a mold part according to the invention for a divisible casting mold according to the invention (preferably according to an embodiment above) or a casting mold according to the invention (preferably as described in more detail above).

In a further aspect, the invention likewise relates to a method for producing a casting from a flowable material, in particular from metal, in a divisible casting mold, with the following steps: producing a casting mold according to the invention (preferably according to a preferred embodiment described above), preferably at least one of the mold parts of the casting mold being produced by a method according to the invention (preferably by one of the preferred methods described above) and/or a mold part according to the invention according to a preferred refinement specified above), pouring flowable material through the sprue created on the feeder insert into a mold cavity in the casting mold, and leaving the flowable material to solidify in the mold cavity. With the aid of the method according to the invention, a casting can be produced in an advantageously reliable way, it being possible at the same time to dispense with a separate gating system. This results in a significantly reduced proportion of material required for the integrated gating system during casting, which is accompanied by reduced costs for the molten material when producing the cast part. By the use of a closed feeder insert according to the invention, which subsequently after the production of the mold part of the casting mold is opened to form a sprue on the feeder insert, the risk of parts of the molding material entering the mold cavity is reduced. As a result, a permanently high reliability of the process is ensured when producing the cast part.

Figure 2:
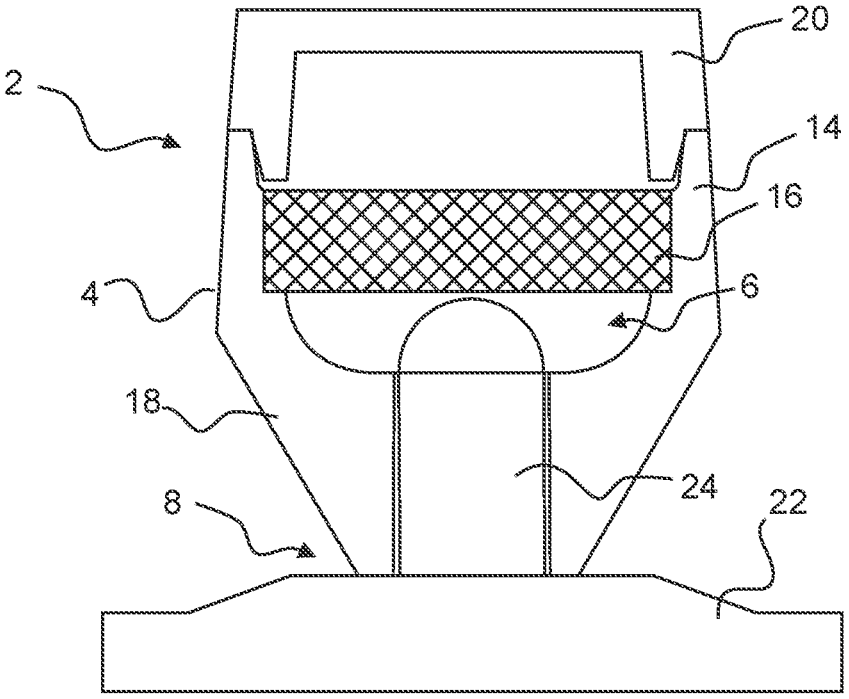
Figure 3:
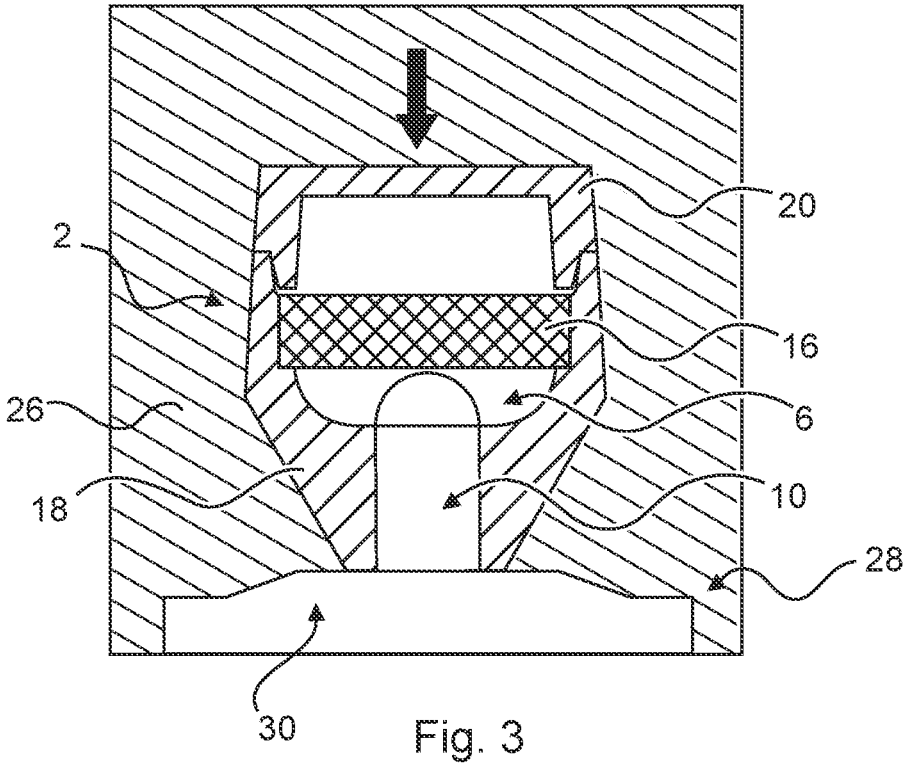
Figure 4:
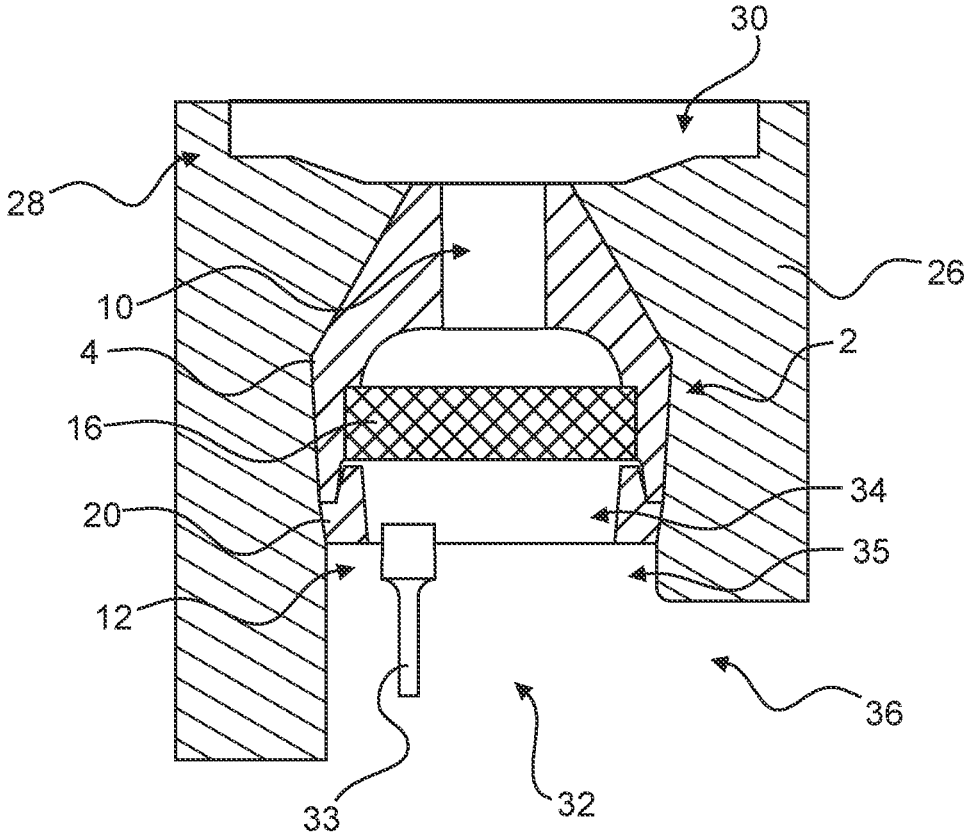
Figure 5:
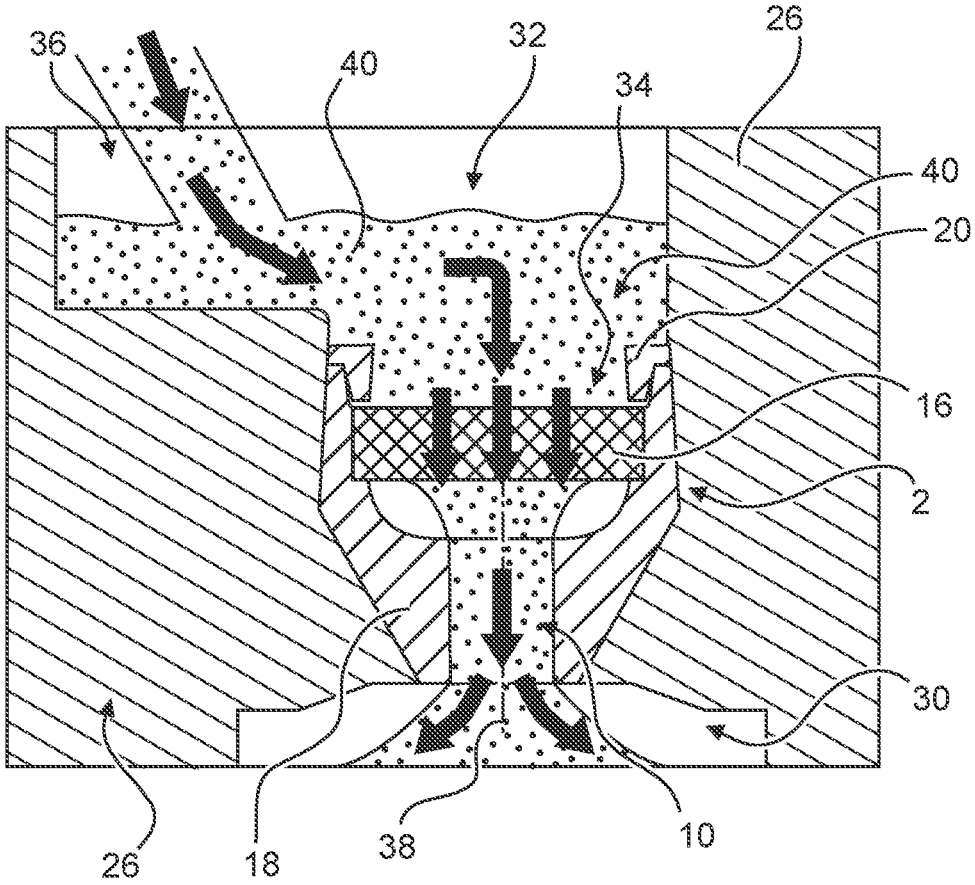
Figure 6:
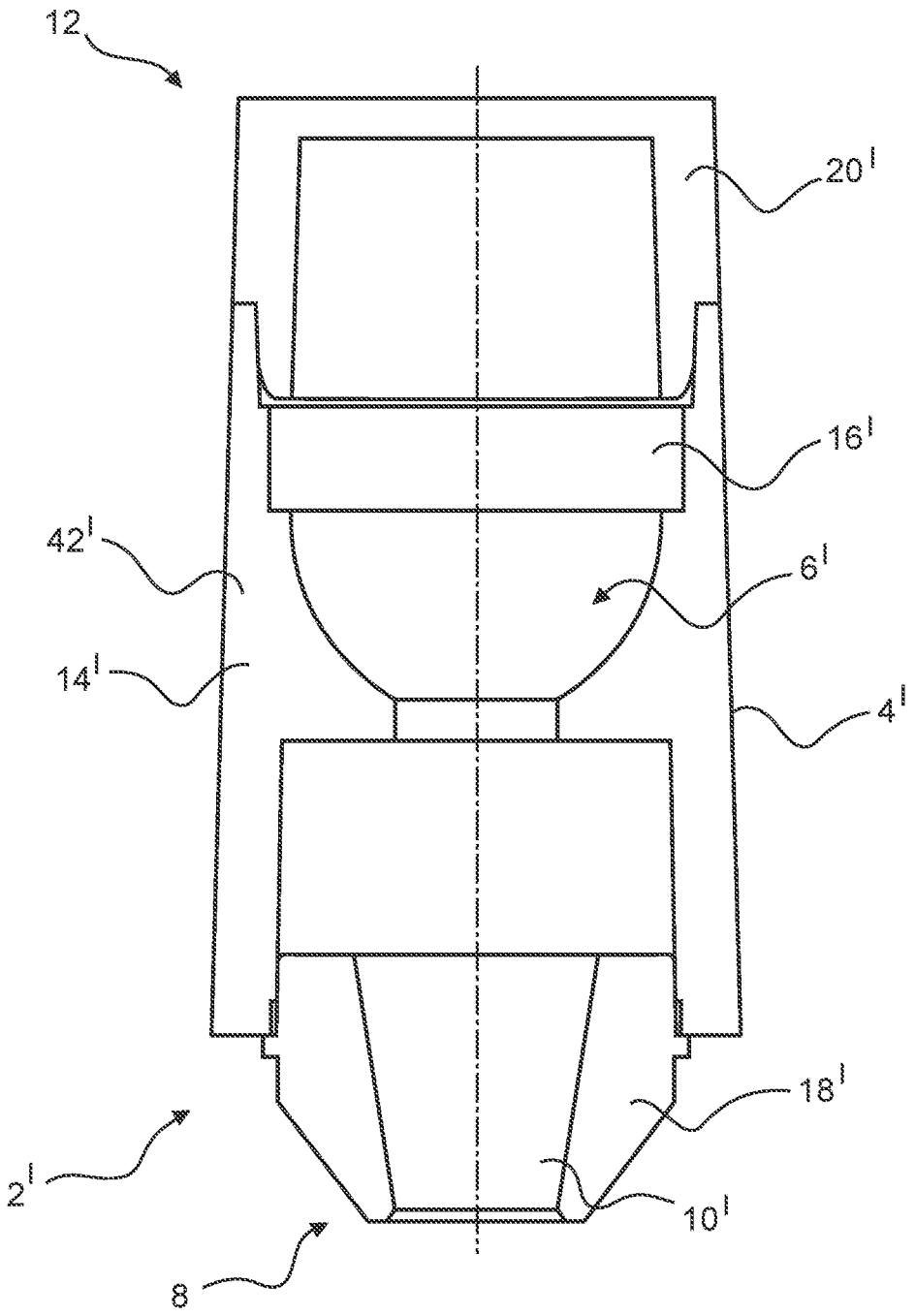
Figure 7:
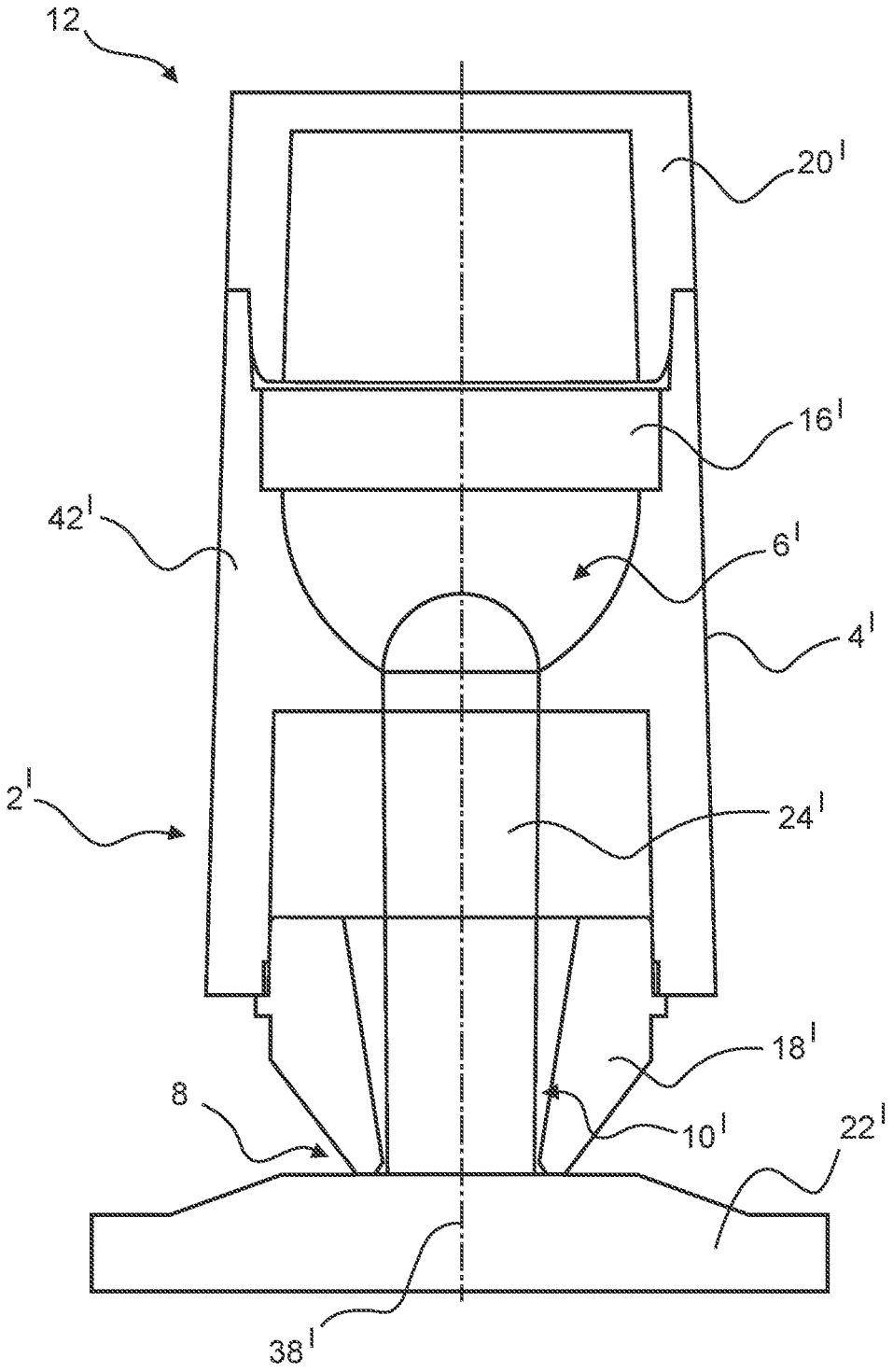
Figure 8:
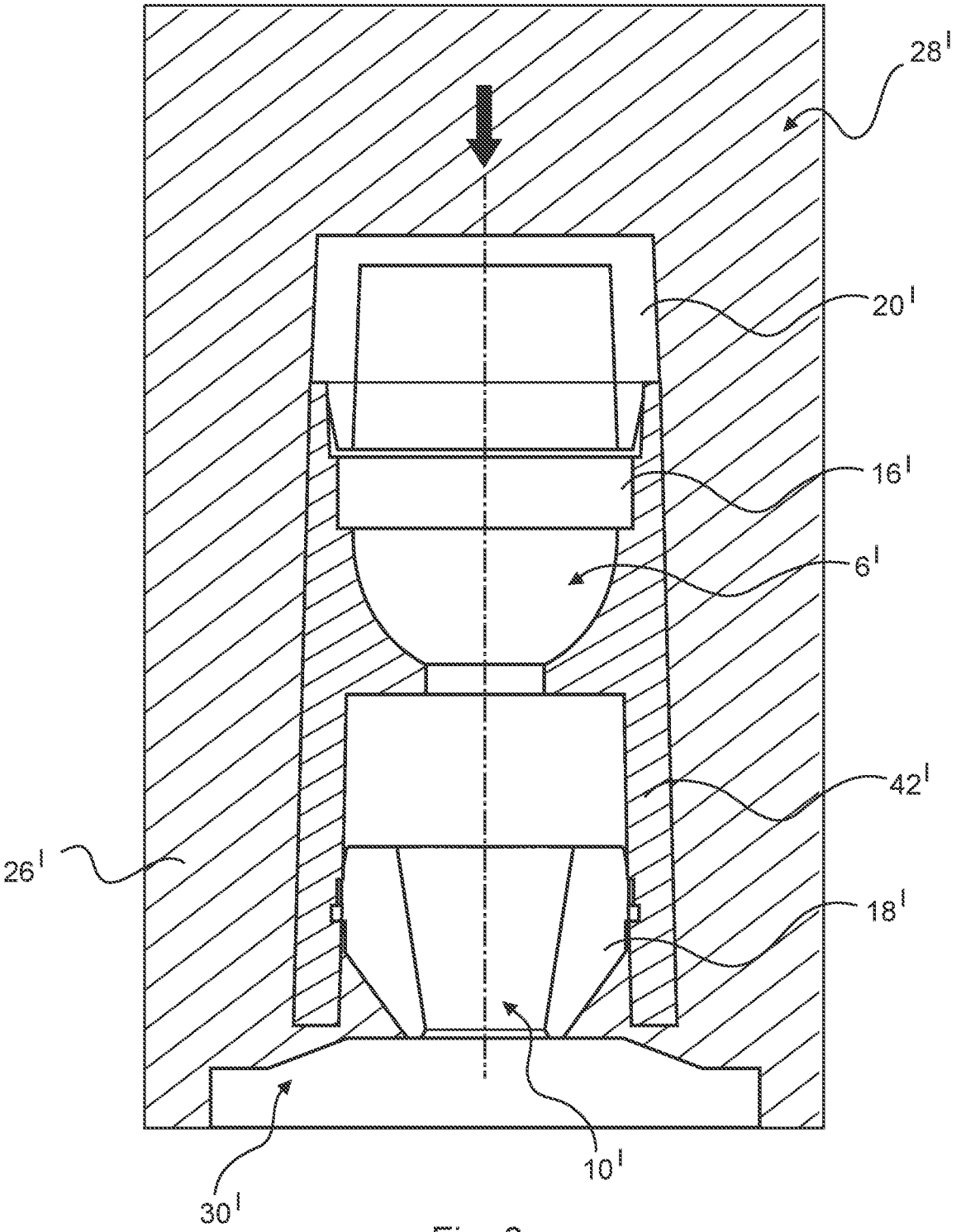
Figure 9:
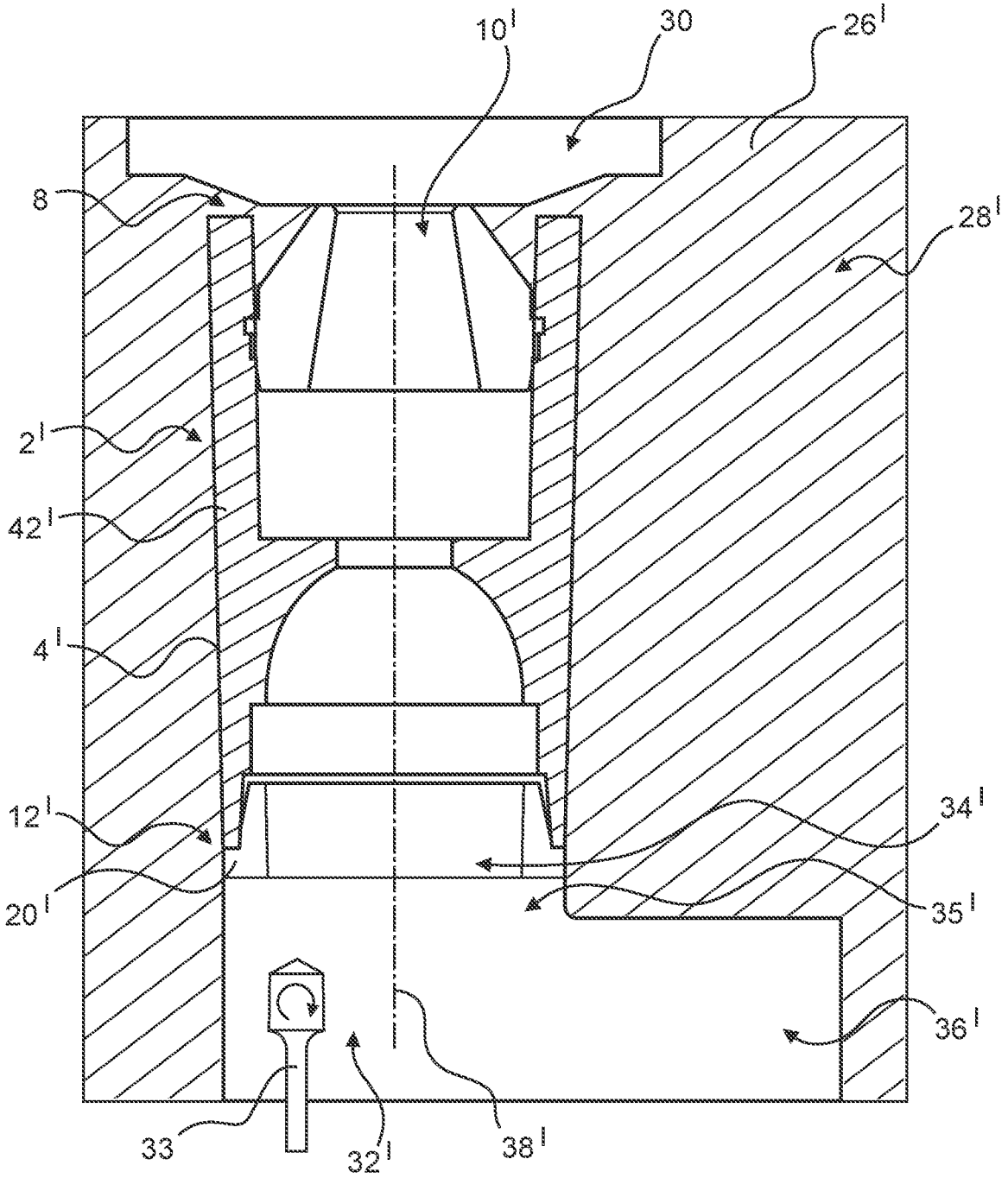
Figure 10:
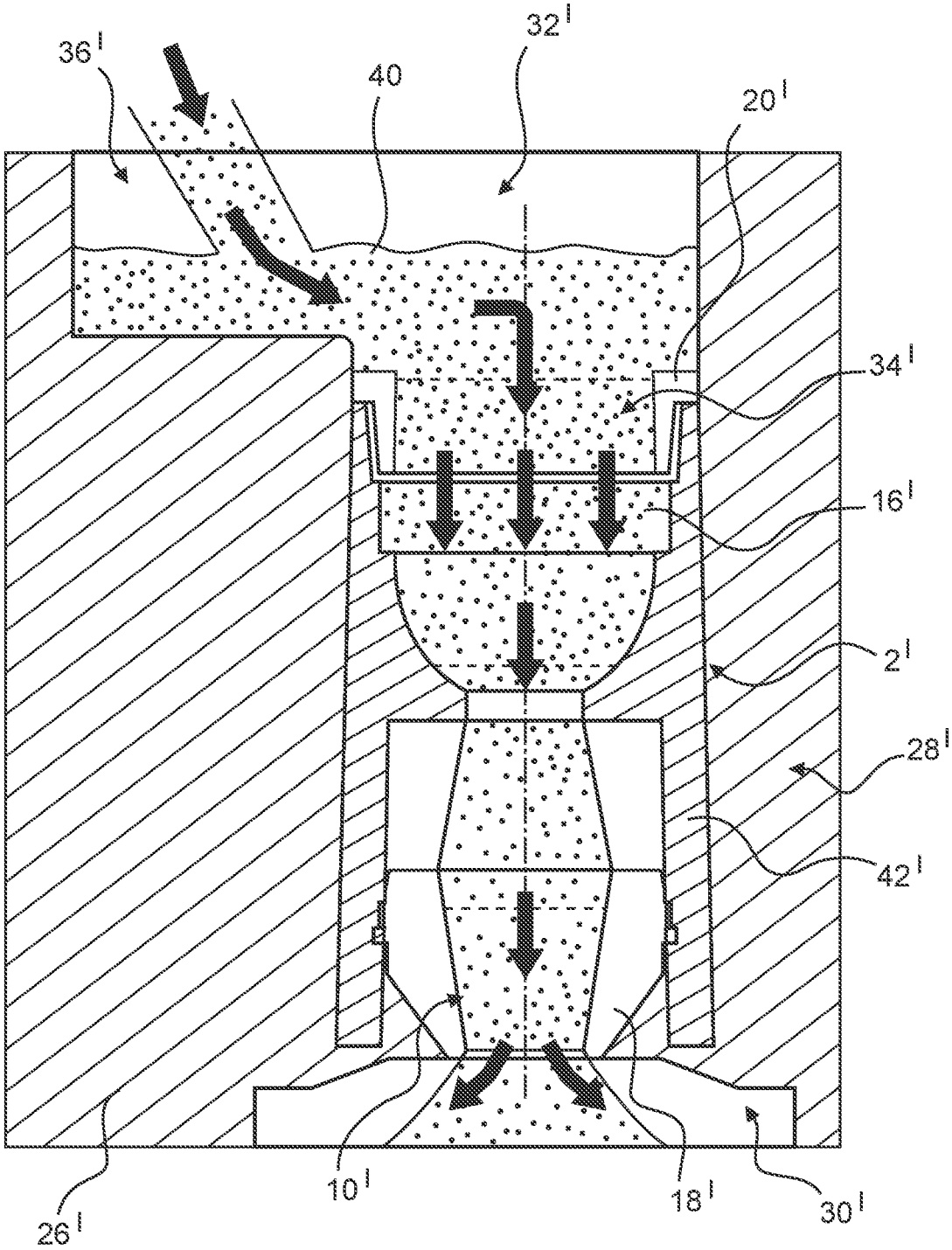
Figure 11:
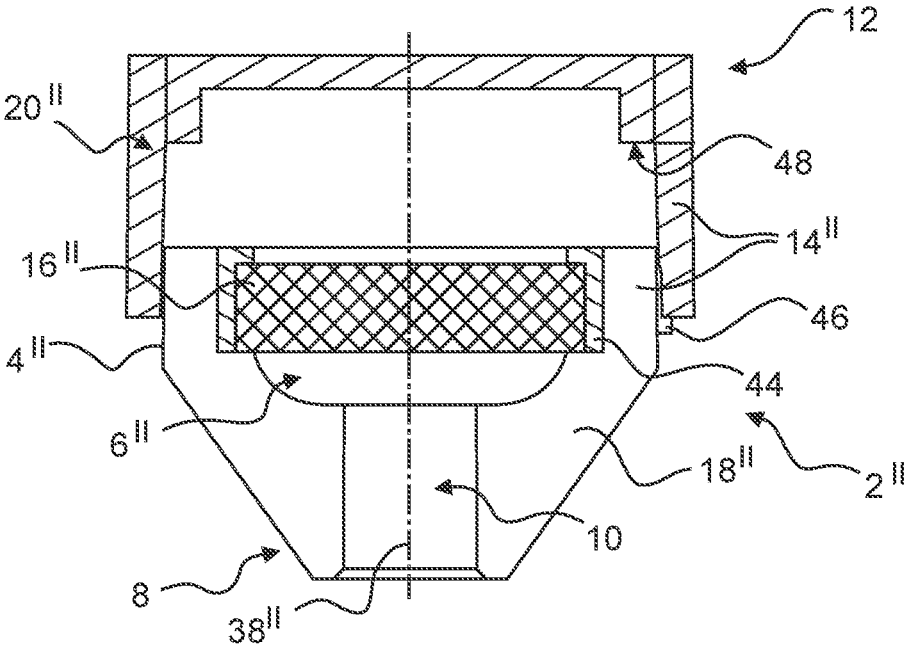
Figure 12:
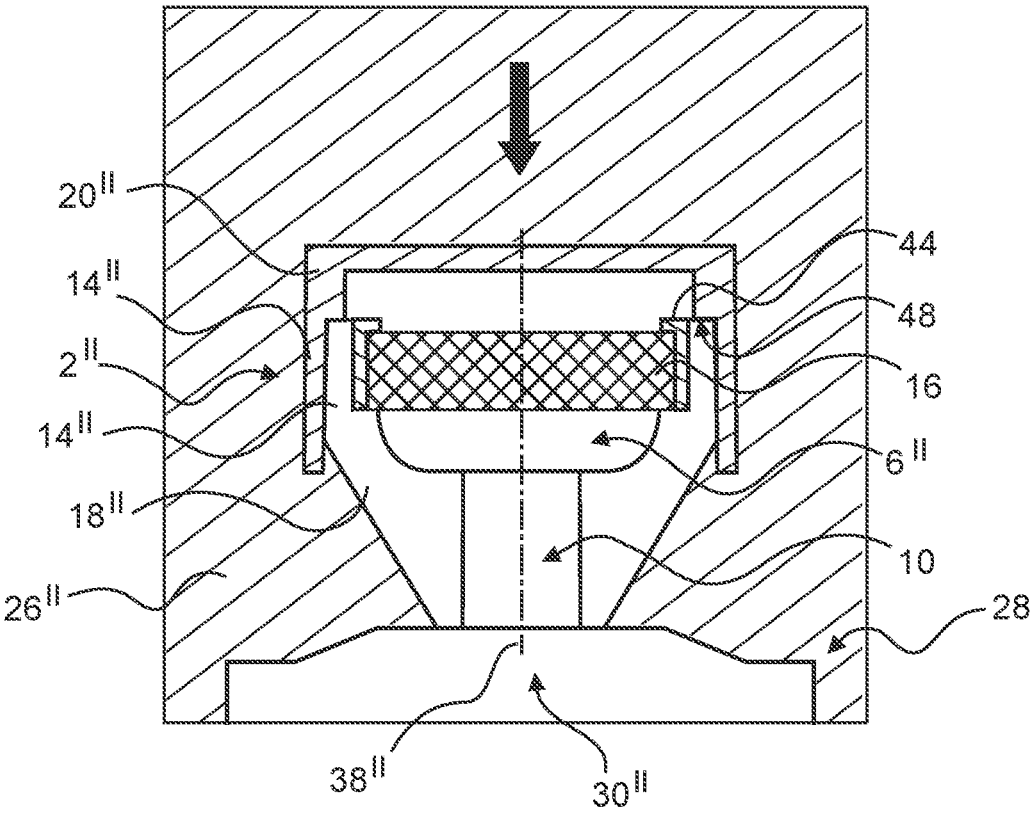
Figure 13:
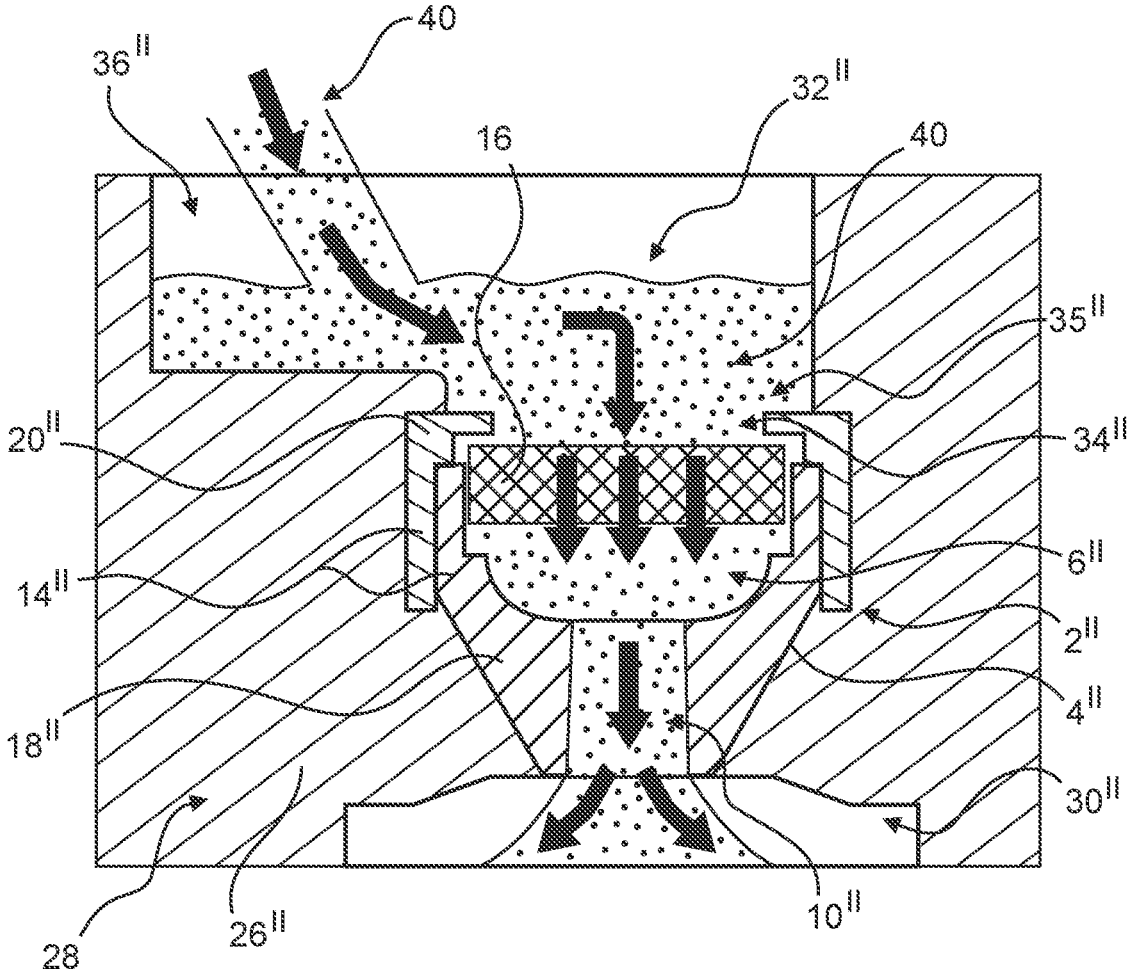

The invention is described in more detail below on the basis of a preferred exemplary embodiment with reference to the accompanying figures, in which:

FIG. 1: shows a view of a first exemplary embodiment of a closed, one-part feeder insert according to the invention in section;

FIG. 2: shows a view of a feeder insert according to the invention as shown in FIG. 1 positioned on a mold plate or a mold pattern;

FIG. 3: shows a partial view of a mold part made from compacted molding material and the closed feeder insert according to the invention arranged in it, after removal of the mold pattern;

FIG. 4: shows a partial view of the turned mold part that illustrates how the feeder insert according to the invention received in it is opened and a sprue is formed;

FIG. 5: shows a view that shows the pouring of liquid metal into the mold cavity of the created casting mold by way of the sprue formed on the sprue insert according to the invention;

FIG. 6: shows a view of a second embodiment of a closed, compressible multi-part feeder insert according to the invention in section;

FIG. 7: shows a view of a feeder insert according to the invention as shown in FIG. 6 positioned on a mold plate or a mold pattern;

FIG. 8: shows a partial view of a mold part made from compacted molding material and the closed, compressed feeder insert according to the invention arranged in it, after removal of the mold pattern;

FIG. 9: shows a partial view of the turned mold part that illustrates how the feeder insert according to the invention received on it is opened and a sprue is formed;

FIG. 10: shows a view that shows the pouring of liquid metal into the mold cavity of the created casting mold by way of the sprue formed on the feeder insert according to the invention according to the second embodiment;

FIG. 11: shows a view of a further embodiment of a closed, compressible multi-part feeder insert according to the invention in section;

FIG. 12: shows a partial view of a mold part made from compacted molding material and the closed, compressed feeder insert according to the invention arranged in it, after removal of the mold pattern, and FIG. 13: shows a view that shows the pouring of liquid metal into the mold cavity of the created casting mold by way of the sprue formed on the feeder insert according to the invention according to the third embodiment.

In FIG. 1, a feeder insert 2 according to the invention according to a first embodiment is shown in section. The feeder insert 2 has a feeder body 4, which comprises a feeder cavity 6 for receiving liquid metal. The feeder insert 2 has at a first end 8 on the feeder body 4 a feeder opening 10, by means of which a connection to a mold cavity 30 in a mold part 26 (FIG. 3) can be established. The feeder body 4 is formed as closed at the opposite second end 12 and has side walls 14 extending between the first end 8 and the second end 12. Arranged in the feeder cavity 6 is a filter element 16, with which material flowing through the feeder insert 2 is cleaned. In the present embodiment, the feeder body 4 is of a one-part form, even if the feeder body consists of multiple individual parts, such as a feeder element 18 and a cover 20. One-part should be understood in the present case as meaning that individual parts of the feeder body, such as for example the cover 20, are not intended to be separated from the feeder body 4. Rather, "one-part" should be understood as meaning that, although the feeder body is made up of multiple individual parts, the individual parts are intended to act permanently together with one another. A one-part feeder body preferably cannot be reversibly dismantled into its individual parts, i.e. after dismantling cannot be readily put together again.

FIG. 2 shows the feeder insert 2 according to the invention in an initial arrangement, serving for producing a mold part according to the invention, on a portion of a mold pattern 22. The feeder insert 2 has been placed with its feeder element 18 at the first end 8 on the mold pattern 22, or positioned on it. The positioning of the feeder insert 2 takes place by means of a centering pin 24, over which the feeder element 18 is pushed with the feeder opening 10.

After that, the mold pattern 22 and the feeder insert 2 arranged on it is surrounded by a molding material, which takes place in particular after arranging the feeder insert 2 in a molding chamber or a molding box, which is not shown in any more detail. After that, the molding material is compacted, so that a mold part 26 shown in FIG. 3 of compacted molding material 28 is formed or produced. After producing the mold part 26, the mold pattern 22 is removed, so that a mold cavity 30 is formed adjacent to the feeder element 20. The mold cavity 30 shown in FIG. 3 in this case defines at least regions of the cast part to be produced.

As FIG. 4 illustrates, in a subsequent method step, the mold part 26 produced is changed in its position, that is to say is turned. For this purpose, the mold part 26 is moved into a position in which the feeder insert 2 is "inverted", the feeder opening 10 being arranged above the second end 12, in which the sprue is to be created. Subsequently, opening of the closed feeder insert 2 takes place at the second end 12 of the feeder body 4, whereby a sprue 32 with at least one pouring opening 34 for the liquid metal is formed. The opening of the feeder insert 2 at the end 20 of the feeder body 4 opposite from the feeder opening 10 takes place by means of working by using a corresponding tool 33. The opening of the feeder insert 2, with the pouring opening 34 being made in the cover 20 of the feeder body 4, involves the associated creation also of a runner 35 and a pouring cup 36 in the compacted molding material 28 of the mold part 26. During the opening of the feeder insert 2 and the forming of the pouring opening 32, the runner 34 and the pouring cup 36, which in the present case define the sprue 32, the mold part is arranged such that, when forming the sprue 32, no molding material gets into the feeder cavity 6 and comes into contact with the filter element 16 arranged in it.

After creating the sprue 32, the mold part 26 is transferred into an alignment usual for use, in which the feeder opening 10 is arranged underneath the pouring opening 34, the longitudinal axis 38 of the feeder insert 2 being vertically aligned in the embodiment shown. The originally closed feeder insert 2 is then formed as a sprue-feeder insert, so that, as FIG. 5 illustrates, a liquid material 40, such as for example metal, is filled in by way of the sprue 32, passes through the feeder insert in the longitudinal direction of the feeder insert 2 and flows into the mold cavity 30. When flowing through the feeder insert 2, the liquid material 40 is cleaned by means of the filter element 16 and the flow of molten material is killed. After solidifying of the liquid material in the mold cavity, the cast part has been created.

FIG. 6 shows a compressible feeder insert 2', which has a feeder body 4', which has a feeder element 18', a feeder part 42' and a cover 20'. In the embodiment shown, the cover 20' is fixedly connected to the feeder part 42' instead of to the feeder element 18'. The cover 20' is a component belonging to the feeder part 42', and consequently is preferably an integral part of the feeder part 42'. The feeder part 42' is a one-part component together with the cover 20'. The feeder insert 2' is a multi-part feeder insert, the feeder insert 2' being a closed feeder insert that is compressible along its longitudinal axis. In the embodiment shown, the feeder element 18' and the further feeder part 42' along with the cover 20' are telescopically displaceable in relation to one another. The feeder element 18' likewise has a feeder opening 10' arranged at the first end 8 of the feeder insert 2'. The feeder insert 2' is likewise formed as closed at its second end 12, in particular is closed by way of the cover 20'. Formed in the feeder body 4' is a feeder cavity 6', within which a filter element 16' is arranged or received. In the present embodiment, the side walls 14' of the feeder insert are formed substantially by the feeder part 42'.

In FIG. 7, the feeder insert 2' according to the invention has been placed on a mold pattern 22. The positioning of the feeder insert 2' on the mold pattern 22 takes place by means of a centering pin 24'. Regions or portions of the feeder element 18' and of the feeder part 42' have been pushed over the centering pin 24' and are directly in contact with it. By means of the centering pin 24', a locational alignment of the feeder insert 2' in relation to the mold pattern 22 and also an angular alignment of the feeder insert 2' in relation to the mold pattern 22 takes place, the feeder insert 2' being aligned with its longitudinal axis 38' in particular perpendicularly to the surface of the mold pattern 22. As also described in relation to the embodiment shown in FIGS. 1 to 5, the mold pattern 22 and the feeder insert 2' arranged on it is arranged for example in a molding chamber or a molding box not shown in any more detail, which delimit at least regions of the mold part to be produced. For producing the mold part, the mold pattern 22 and the feeder insert 2' arranged on it in the molding chamber or the molding box is surrounded at least in certain regions by molding material, which is used for forming a mold part. For this purpose, the molding material used for forming the mold part is filled into the molding chamber or the molding box and then surrounds the mold pattern 22 and the feeder insert 2'.

After that, the molding material 28, which is still in a loose form, is compacted. With the compacting of the molding material 28, indicated in FIG. 8, a solid mold part 26' is created. On account of the telescopic configuration of the feeder insert 2', when compacting the molding material a relative movement of the feeder element 18' and the feeder part 42' (including the cover 20') in relation to one another takes place. In particular, the feeder part 42' is pushed, at least with a portion thereof, over the feeder element 18'. The closed feeder insert 2' according to the invention is consequently compressible along its longitudinal axis 38'. In an embodiment of the invention that is not shown, instead of the telescopic configuration of the feeder insert 2', a feeder insert that is compressible, in particular is non-reversibly compressible, is provided.

After the compacting and the associated production of the mold part 26', the mold part 26' is changed in its position, that is to say is rotated or turned. The closed feeder insert 2' is consequently inverted, so that the feeder opening 10 at the first end 8 is arranged above the closed second end 12. After changing the position or aligning the created mold part 26', it is worked in the region of the feeder insert 2' and by means of the tool 33 the runner 35' and the pouring cup 36' for a sprue 32' are created in the compacted molding material. In addition to the removal of the molding material, the feeder insert 2 is opened at the closed end 12, i.e. in the region of the cover 20', and a pouring opening 34' for the sprue 32' is formed. By working the molding material 28 from the underside of the mold part 26', the detached molding material does not get into the interior of the feeder insert, and consequently does not get into the feeder cavity 6'. Consequently, the detached material falls downward because of gravitational force, so that the filter element 16' does not become clogged. After the opening of the multi-part feeder insert 2', it is turned back by about 180°. The feeder insert 2' then has its usual alignment, so that the sprue 32' is arranged above the feeder opening 10'. The longitudinal axis 38' of the feeder insert 2 has in the embodiment shown a vertical alignment. In the alignment advantageous for use, shown in FIG. 10, liquid metal 40 is then introduced into the previously closed feeder insert 2', which is then formed as a sprue-feeder insert, and flows by way of the sprue 32' through the feeder cavity 6', the filter element 16' and the feeder opening 10' into the mold cavity 30' in the mold part 36'

In FIG. 11, a further, third embodiment of a feeder insert 2" according to the invention is shown in section. The feeder insert 2" has a feeder body 4", which has a feeder cavity 6" for receiving liquid metal. The feeder insert 2" has at the first end 8 of the feeder body 4" a feeder opening 10. By means of the feeder opening 10, a connection to the mold cavity 30" of a mold part 26" is created (FIG. 13). The feeder body 4" is formed as closed at the opposite, second end 12. In the embodiment shown, the feeder body 4 is closed by a cover 20", which is coupled to a feeder element 18". From the first end 8 to the second end 12 of the feeder body 4", side walls 14" extend. Arranged within the feeder cavity 6" is a filter element 16", which is designed to clean liquid metal filled into the mold cavity 30" of the mold part 26" by way of the feeder insert 2". The filter element 16" has smaller outer dimensions in comparison with the receiving region on the feeder element 18''' for the filter element. The filter element 16" is movable within the feeder insert 2".

The feeder body 4", which is made up only of a feeder element 18" and the cover 20", is of a two-part form in the embodiment shown. In the present case, the feeder element 18" and the cover 20" are telescopically displaceable in relation to one another. The feeder insert 2" is consequently formed as compressible in the direction of its longitudinal axis 38". The filter element 16" is held in position in the interior of the feeder body 4" by means of a securing element 44. In the present embodiment, the securing element 44 is a a ring body of a foamed plastic. The material used for forming the securing element 44 is a thermally destructible material. Also provided on the feeder element 18" of the feeder body 4" are holding elements 46, with which the cover 20" is held in an initial position in relation to the feeder element 18". Unwanted premature displacement or telescoping of the feeder element 18" and the cover 20" in relation to one another is avoided. The holding elements 46 are designed to break away from the feeder element 18" or to be deformed and/or to penetrate into the side wall 14" of the cover 20" above a certain minimum compressive force.

As similarly revealed by FIGS. 2 and 7, the feeder insert 2" is placed onto a mold pattern not shown in any more detail with a centring pin. Subsequently, the feeder insert 2" together with the mold pattern is surrounded by a molding material 28, which takes place in particular after arranging the feeder insert 2" in a molding chamber or a molding box, which is likewise not shown in any more detail.

FIG. 12 shows the feeder insert 2" according to the invention within a mold part 26" already produced from the compacted molding material 28 and after the removal of the mold pattern defining the mold cavity 30" within the mold part 26". With the compacting of the molding material 28, the cover 20" reaching over the outside of the feeder element 18" is displaced in the direction of the longitudinal axis 38" of the feeder insert 2", and in this way the feeder insert 2" is compressed. The side walls 14" of the cover 20" push over the side walls 14" on the outside of the feeder element 18". The cover 20" has a stop 48, which comes into contact with the second end of the feeder element 18" when the cover 20" is displaced. By means of the stop 48, the telescoping capability of the feeder element 18" and the cover 20" is limited. Consequently, a cavity remains above the filter element 16" in the feeder insert 2" for its freedom of movement.

As shown similarly in FIGS. 4 and 9 in relation to the other embodiments, after the production of the mold part 26", in inverted alignment on the arrangement consisting of the mold part 26" and the feeder insert 2", by means of a tool 33 at least the feeder insert 2" is opened, in particular the sprue 32", comprising a pouring opening 34" on the feeder insert 2", a runner 35" and a pouring cup 36" (FIG. 13) is created.

After the forming of the sprue 32" and the associated opening of the feeder insert 2", the mold part 26" with the feeder insert 2" is brought into the alignment advantageous for usual use, shown in FIG. 13. After that, liquid material 40, in particular liquid metal, is filled into the sprue 32". The liquid material 40 flows through the feeder insert 2" into the mold cavity 30" of the mold part 26. With the filling in of the liquid material, which is at a temperature of several hundreds of degrees, the securing element 44 holding the filter element 16" in position is destroyed, so that, as FIG. 13 illustrates, the filter element 16" in the feeder cavity 6" of the feeder insert 2" is released. When the liquid metal rises up in the feeder cavity 6" of the feeder insert 2", the filter element 16" floats on the molten material.

It goes without saying that, for simplified representation of the invention, the figures reproducing the casting operation, FIGS. 5, 10 and 13, only show regions of the mold part 26, 26', 26" and only segments of a casting mold required for producing a cast part. To form a complete casting mold, at least one further mold part is required, delimiting the lower part of the cast part to be produced that is not represented.

LIST OF DESIGNATIONS

2, 2', 2" Feeder insert
4, 4', 4" Feeder body
6, 6', 6" Feeder cavity
8 First end
10, 10' Feeder opening
12 Second end
14, 14', 14" Side wall
16, 16', 16" Filter element
18, 18', 18" Feeder element
20, 20', 20" Cover
22 Mold pattern
24, 24' Centering pin
26, 26', 26" Mold part
28 Molding material
30, 30', 30" Mold cavity
32, 32', 32" Sprue
33 Tool
34, 34', 34" Pouring opening
35, 35', 35" Runner
36, 36', 36" Pouring cup
38, 38', 38" Longitudinal axis
40 Material
42' Feeder part
44 Securing element
46 Holding element
48 Stop

The invention claimed is:

1. A method for producing a mold part (26, 26', 26") with a feeder insert arranged in it, with a sprue for liquid metal, for a divisible casting mold for metal casting, with the following steps:

producing or providing a mold part (26, 26', 26") equipped with a closed feeder insert (2, 2', 2") from a compacted molding material (28), the closed feeder insert (2, 2', 2") being arranged fixed in place in the compacted molding material (28) of the mold part (26, 26', 26") and having a feeder opening (10, 10') connected to regions of a mold cavity (30, 30', 30") that is to be formed or has partially formed, wherein the feeder insert (2") is a multi-part feeder insert having a feeder element (18") and a cover (20"), wherein the feeder element (18") and the cover (20") are telescopically displaced in relation to one another, wherein the feeder insert is directly in contact with a mold plate or with a mold pattern or is positioned at a small distance from the mold plate and/or the mold pattern and the feeder insert (2") comprises a filter element held in position at the feeder element (18") by a securing element (44) during production of the mold part (26") and opening the closed feeder insert (2, 2', 2"), so that a sprue (32, 32', 32") for liquid metal is formed.

2. The method as claimed in claim 1, the production of the mold part (26, 26', 26") equipped with the closed feeder insert (2, 2', 2") comprising the following steps:

arranging the closed feeder insert (2, 2', 2") in a molding chamber or a molding box;

filling molding material (28) into the molding chamber or the molding box, the closed feeder insert (2, 2', 2") being surrounded at least in certain regions by the molding material (28), and compacting the filled-in molding material (28), so that the mold part (26, 26', 26") is produced and the closed feeder insert (2, 2', 2") is received fixed in place in the compacted molding material (28).

3. The method as claimed in claim 1, the production of the mold part (26, 26', 26") equipped with the closed feeder insert (2, 2', 2") comprising the following step:

compacting the molding material (28) in contact with the closed feeder insert (2, 2', 2"), so that the closed feeder insert (2, 2', 2") is embedded in an interlocking manner in the mold part (26, 26', 26") produced.

4. The method as claimed in claim 1, the production of the mold part equipped with the closed feeder insert (2, 2', 2") comprising the following steps:

positioning the closed feeder insert (2, 2', 2") on a mold plate and/or a mold pattern or at a distance from a mold plate and/or a mold pattern, the closed feeder insert (2, 2', 2") being positioned by means of a positioning device, and forming a molding chamber or a molding box for the molding material (28) to be compacted at least in certain regions, from the mold plate and/or the mold pattern (22) and at least one pressing plate that is movable in relation to the mold plate and/or the mold pattern (22).

5. The method as claimed in claim 1, the production of the mold part (26, 26', 26') equipped with the closed feeder insert (2, 2', 2") also comprising the following steps:

providing a closed feeder insert (2', 2") that is compressible substantially along its longitudinal axis (38', 38");

compressing the closed feeder insert (2', 2") in the direction of its longitudinal axis (38', 38") when compacting the molding material (28).

6. The method as claimed in claim 1, the opening of the closed feeder insert (2, 2', 2") comprising one, more than one, or all of the following steps:

changing the position of the mold part (26, 26', 26") produced together with the closed feeder insert (2, 2', 2") arranged fixed in place before the opening of the feeder insert, so that the part of the feeder insert (2, 2', 2') later having the sprue (32, 32', 32") is arranged with respect to a horizontal plane underneath the feeder opening (10, 10') connected to regions of the mold cavity (30, 30', 30") to be formed;

opening the feeder insert (2, 2', 2") at a position at a distance from the feeder opening (10, 10'), and working the closed feeder insert (2, 2', 2") or working the closed feeder insert (2, 2', 2") and regions of the compacted molding material (28) surrounding the feeder insert for opening the feeder insert (2, 2', 2") in a or the changed position of the mold part (26, 26', 26") produced, together with the feeder insert (2, 2', 2") received fixed in place.

7. The method of claim 6, wherein the step of changing the position of the mold part (26, 26', 26") comprises turning the mold part (26, 26', 26") so that the part of the feeder insert (2, 2', 2') later having the sprue (32, 32', 32") is arranged with respect to a horizontal plane underneath the feeder opening (10, 10') connected to regions of the mold cavity (30, 30', 30") to be formed.

8. The method of claim 6, wherein the step of opening the feeder insert (2, 2', 2") at a position at a distance from the feeder opening (10, 10') comprises opening the feeder insert (2, 2', 2") at an end portion of the feeder opposite from the feeder opening (10, 10').

9. The method as claimed in claim 1, with the following step:

opening the closed feeder insert (2, 2', 2") and forming the sprue (32, 32', 32") on the feeder insert (2, 2', 2") or on the feeder insert (2, 2', 2") and the produced mold part (26, 26', 26") by machining, leaving after the formation of the sprue (32, 32', 32") regions of the mold part (26, 26', 26") which reach over wall regions of the feeder insert (2, 2', 2") with respect to the pouring-in direction for the liquid metal, so that an undercut enclosing the feeder insert (2, 2', 2") is formed and/or removal of the feeder insert (2, 2', 2") from the mold part (26, 26', 26") produced is prevented.

10. A method for producing a mold part (26, 26', 26") with a feeder insert arranged in it, with a sprue for liquid metal, for a divisible casting mold for metal casting, with the following steps:

producing or providing a mold part (26, 26', 26") equipped with a closed feeder insert (2, 2', 2") from a compacted molding material (28), the closed feeder insert (2, 2', 2") being arranged fixed in place in the compacted molding material (28) of the mold part (26, 26', 26") and having a feeder opening (10, 10') connected to regions of a mold cavity (30, 30', 30") that is to be formed or has partially formed, wherein the feeder insert (2") is a multi-part feeder insert having a feeder element (18") and a cover (20"), wherein the feeder element (18") and the cover (20") are telescopically displaced in relation to one another, wherein the feeder is directly in contact with a mold plate or with a mold pattern or is positioned at a small distance from the mold plate and/or the mold pattern and the feeder insert (2") comprises a filter element having an outer diameter held in position at the feeder element (18") by a securing element (44) during production of the mold part (26") and opening the closed feeder insert (2, 2', 2"), so that a sprue (32, 32', 32") for liquid metal is formed, wherein the step of opening the closed feeder insert comprises generating an opening in the cover of the feeder insert wherein the opening in the cover has dimensions that are larger than the outer diameter of the filter element to permit the filter element to float on liquid metal during metal casting to increase feeding volume of the feeder element.

11. The method of claim 10, wherein the cover (20"), following the opening step, comprises an abutment to stop the filter element that is floating on liquid metal during metal casting from floating into the sprue.

* * * * *